United States Patent [19]

Kawasaki

[11] Patent Number: 4,885,698

[45] Date of Patent: Dec. 5, 1989

[54] OVERLOAD PREVENTION APPARATUS FOR JACKING SYSTEM OF OFFSHORE STRUCTURES

[75] Inventor: Josho Kawasaki, Tokyo, Japan

[73] Assignee: Mitsui Ocean Development & Engineering Co., Ltd., Tokyo, Japan

[21] Appl. No.: 259,286

[22] Filed: Oct. 18, 1988

Related U.S. Application Data

[63] Continuation of Ser. No. 872,283, Jun. 9, 1986, abandoned.

[30] Foreign Application Priority Data

Jul. 28, 1985 [JP] Japan ..... 60-163899

[51] Int. Cl.[4] ..... G06F 15/20; H02K 7/14; E02B 17/08

[52] U.S. Cl. ..... 364/506; 188/180; 254/95; 405/198; 318/8; 318/15; 318/98

[58] Field of Search ..... 364/505, 506, 508; 187/17, 110, 111, 113; 188/180, 182; 254/95, 97, DIG. 2, DIG. 9; 405/198; 318/8, 12, 15, 41, 45, 77, 78, 98, 99, 63, 64, 625, 432; 74/665 A–E

[56] References Cited

U.S. PATENT DOCUMENTS

| | | | |
|---|---|---|---|
| 3,434,025 | 3/1969 | Parkinson et al. | 318/8 |
| 3,593,092 | 7/1971 | Flippo | 318/8 X |
| 3,789,280 | 1/1974 | Oldfield | 318/77 X |
| 3,886,417 | 5/1975 | Niwa | 318/99 X |
| 4,035,705 | 7/1977 | Miller | 318/8 X |
| 4,087,731 | 5/1978 | Rhoades | 318/8 X |
| 4,269,543 | 5/1981 | Goldman et al. | 254/95 X |
| 4,521,134 | 6/1985 | Schoonmade | 254/95 X |
| 4,525,655 | 6/1985 | Walker | 318/45 |
| 4,547,857 | 10/1985 | Alexander | 364/505 |
| 4,614,901 | 9/1986 | Kullman et al. | 318/99 |
| 4,657,438 | 4/1987 | Gillis | 405/198 |
| 4,668,127 | 5/1987 | Steele | 405/198 |

FOREIGN PATENT DOCUMENTS

| | | | |
|---|---|---|---|
| 2064624 | 6/1981 | United Kingdom | 405/198 |

*Primary Examiner*—Parshotam S. Lall
*Assistant Examiner*—Joseph L. Dixon
*Attorney, Agent, or Firm*—Bierman & Muserlian

[57] ABSTRACT

An overload prevention apparatus for a jacking system of a rack and pinion type for use in offshore structures is disclosed. Each of the pinions is provided with a torque meter and tachometer for detecting a relative position between the pinion and the rack. The information detected by the torque meter and the tachometer are respectively fed to a computer the output of which is supplied to an adjust unit for equalizing the load on the jacking system.

1 Claim, 3 Drawing Sheets

OVERLOAD PREVENTION APPARATUS FOR JACKING SYSTEM OF OFFSHORE STRUCTURES

This is a continuation, Ser. No. 872,283 filed June 9, 1986 now abandoned.

FIELD OF THE INVENTION

This invention relates to an overload prevention apparatus for a jacking system of a rack and pinion type for use in offshore drilling structures.

BACKGROUND OF THE INVENTION

In general, an offshore structure consists of a buoyant platform and a plurality of legs and it has been widely used for offshore operations, such as drilling and completing oil and gas wells in the offshore. At a state in which the movable legs are fully raised up, the buoyant platform is towed to the desired location, the legs are lowered by the jacking system so that the platform is supported on the sea floor. Then the platform is raised above the surface of a body of water for operations. For the purpose of raising or lowering the legs or the platform, a "rack and pinion type" jacking system is widely used. The jacking system of this type includes at least one elongated rack which is mounted vertically on the exterior side surface of the upright legs and extends substantially through the entire length of the same, and a plurality of cooperating pinions engaged with each of the racks. Each of pinions is driven through a series of reduction gears by means of a respective electric motor.

When the platform is supported by the upright legs on the sea floor, this support is effected by the engagement of the rack with the pinion of the jacking system. In this manner, during offshore operations the load which is composed of the self-weight of the platform and environmental forces such as wind, wave, current and others is placed on the jacking system in engagement of the rack with the pinion.

The jacking system generally has large number of pinions in the whole platform. The load on the jacking system is not distributed equally among said pinions for many and various reasons. Therefore, after the platform is jacked up to the desired height, the load on each pinion is commonly adjusted by means of a manual device within certain range.

However as the environmental forces shall increase after the load adjustment, the load on the pinions will become larger unequally owing to the difference of elastic deformation in component of jacking system. In such situation the load on a specific pinion will reach the limit while the load on each of the other pinions will be remained within the limit.

OBJECTS OF THE INVENTION

In the light of the above, a main object of the present invention is to provide an overload prevention apparatus for the jacking system of a rack and pinion type of the offshore structure by means of equalizing the loads among pinions, when the legs are lowered down on the sea floor and the jacking system is in the braking mode.

A further object of the present invention is to provide an overload prevention apparatus for the jacking system which is simple in construction, less to modify the conventional jacking system, easy to operate and economical to manufacture and maintain.

These and other objects will become more apparent during the course of the following detailed description and claims.

DESCRIPTION OF THE INVENTION

Figure 1:
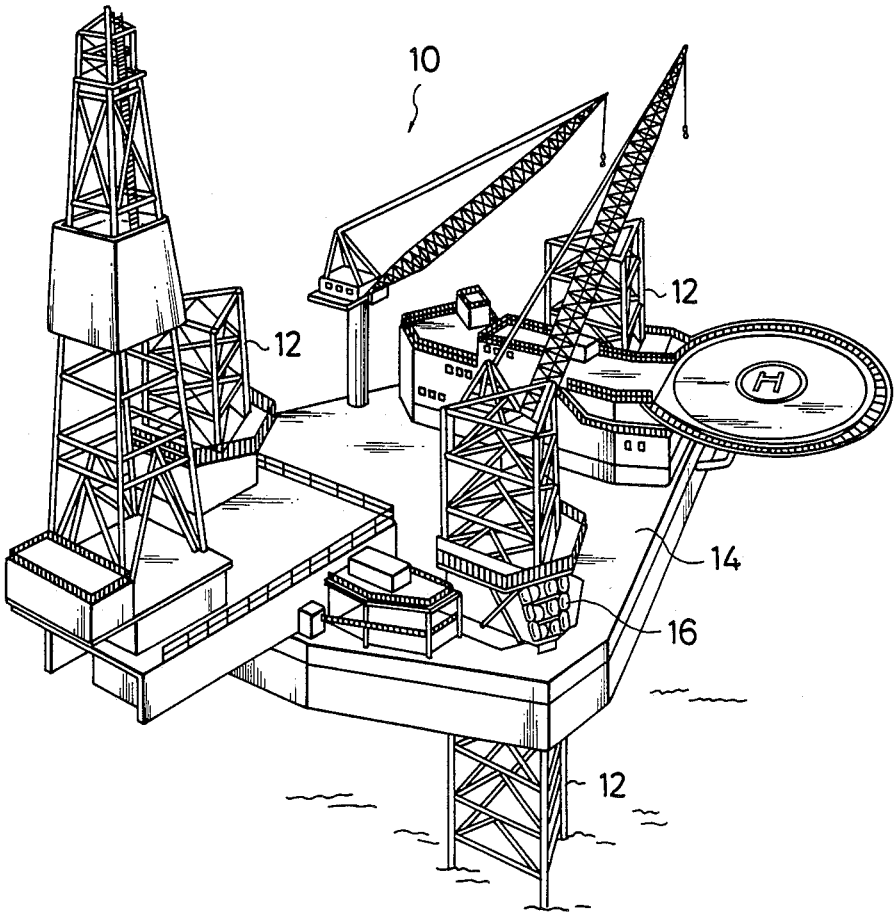
FIG. 1 shows a schematic perspective view of a self-elevating drilling platform in which the overload prevention apparatus for the jacking arrangement of the rack and pinion type according to the present invention may be employed.
Figure 2:
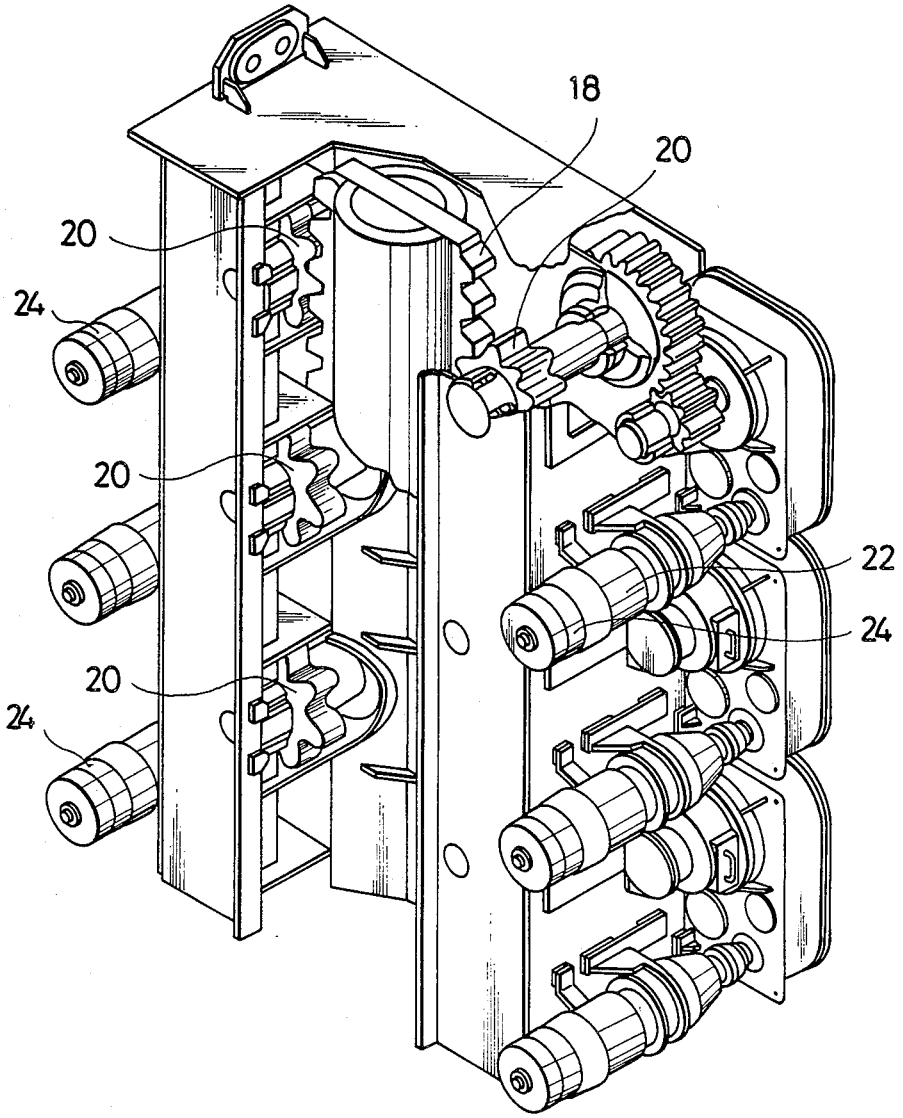
FIG. 2 is an example of the rack and pinion type jacking system.

Referring now to FIG. 1 of the drawings, there is shown a self-elevating drilling platform 10 having at least three upright legs 12 extending through a buoyant platform 14 vertically and each of legs 12 is raised or lowered by a jacking system 16. The platform 14 may be towed to a desired offshore drilling location by, for example, boats. When the self-elevating drilling platform 10 is reached at the desired location, the legs are lowered down in a body of water so that a footing of each of legs is set on the sea floor, and the platform 14 is then raised to a sufficient height above the surface of a body of water so as to minimize the effect of tide and waves. The jacking system 16 includes a plurality of pinions 20 each of which engages with one of a pair of elongaged racks 18 which are mounted vertically on the exterior side surface of the upright leg 12 in diametrically opposed relation and extend substantially throughout the entire length of the leg 12. The pinion 20 is driven by a respective electric motor 22 arranged within the jacking system 16. The electric motor 22 of the jacking system 16 is provided with a brake 24 for holding a relative position between the legs 12 and the platform 14.

Figure 3:
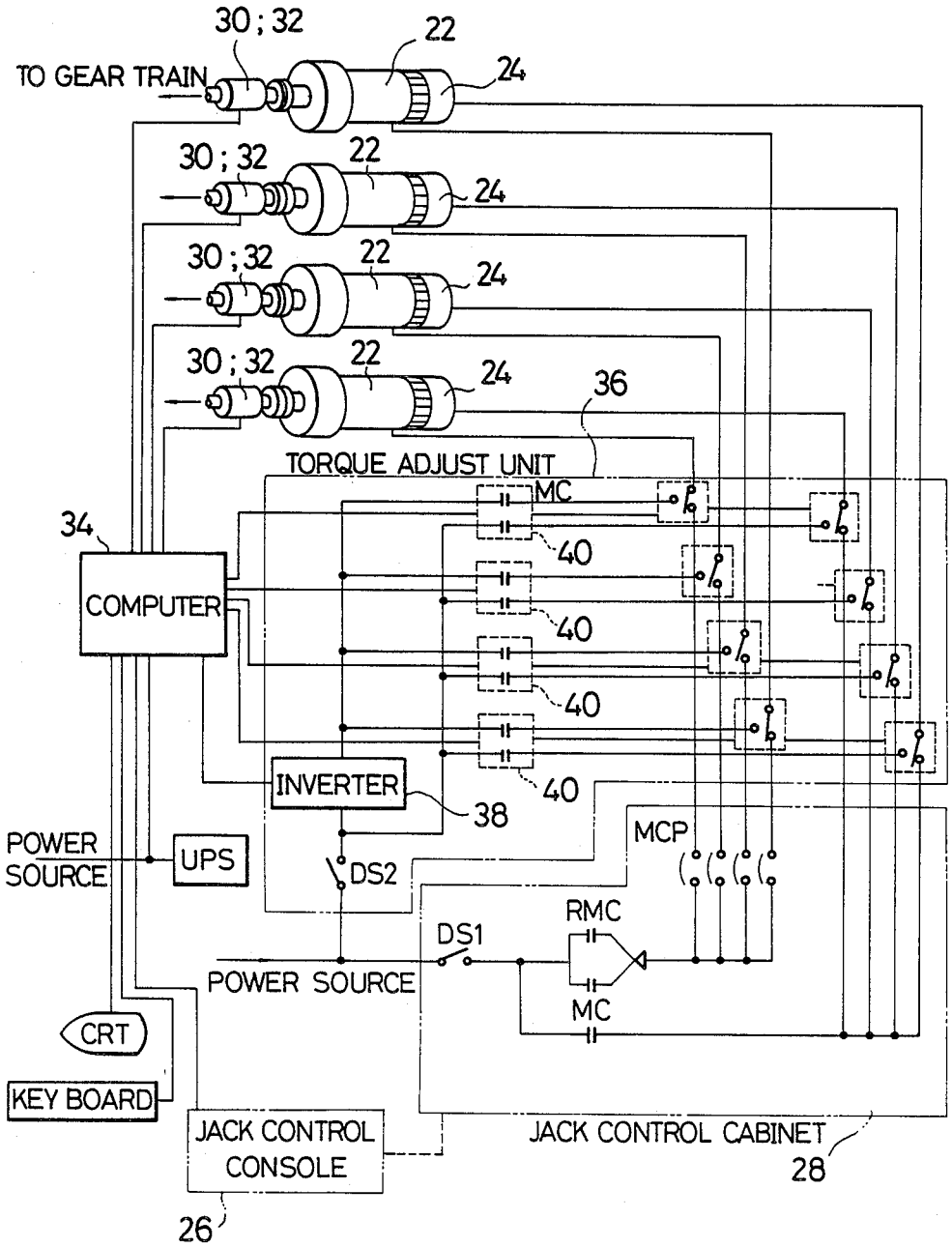
FIG. 3 shows a schematic diagram of an electric circuit in connection with the overload prevention apparatus for the jacking system according to the invention.

The jacking system 16 mentioned above cannot only lift up the platform 14 but also hold the platform 14 over the sea. As shown in FIG. 3, a control console 26 and a control cabinet 28 are included in the electric circuit to drive the motor 22 which is well known in the art and does not constitute a part of the present invention, and therefore the detail of the above will be omitted.

According to the present invention, the overload prevention apparatus for the jacking system comprises a torque meter 30, a tachometer 32, a computer 34 which receives information from the torque meter 30 and the tachometer 32, and a torque adjust unit 36 connected between the computer 34, the motor 22 and the brake 24. Outputs of the computer 34 may be supplied to the circuit connecting the motor 22 with the control cabinet 28.

The torque adjust unit 36 is provided with an inverter 38 which has capacity for controlling the electric motors 22, a pair of electromagnetic contactor 40 for selecting the electric motor 22 and the brake 24 to be adjusted, and change-over switches 14 for switching motor drive circuit and torque adjust circuit.

According to the apparatus of the present invention, the torque meter 30 and the tachometer 32 detect the load applied to the corresponding pinion 20, the position of engagement of the rack 18 with the pinion 20, and the angle of rotation of the shaft of the pinion 20.

The information detected by the torque meter 30 is supplied to the computer 34.

The computer 34 calculates the optimum torque for each pinion by means of input torque data and the base data of the load distribution which are stored in the computer 34 previously.

The computer 34 changes the connection of the motor 22 and brake 24 from driving circuit to torque adjust circuit by the change-over switches 41 for the motor with a brake to be adjusted.

The inverter 38 turns the motor shaft slightly until torque on the motor with a brake reaches to the set value which is transmitted from the computer 34 when the computer 34 closes a pair of magnetic contactors 34.

While the inverter 38 turns the motor shaft, the tachometer 32 monitors rotation of the motor shaft and feeds it back to the inverter 38 through the computer 34.

Above adjusting procedure is applied to all motors one by one until all motors are in the desired value of torque.

According to the present invention, it is not necessary to modify or change the arrangement of the conventional jacking system of the rack and pinion type. Therefore the apparatus according to the present invention can be easily applied to the conventional jacking system to attain all of the above mentioned effects.

While the preferred form of the present invention has been described, it is to be understood that modifications will be apparent to those skilled in the art without departing from the spirit of the invention.

The scope of the invention, therefore, is to be determined solely by the following claim.

What is claimed is:

1. A jacking system for an offshore structure having movable legs, the system comprising a plurality of elongated racks installed on each of the legs of the offshore structure, a plurality of pinions engaging with each said rack, an electric motor with a brake for independently driving each said pinion, and electric circuit means for controlling each said electric motor, said motor driving its associated pinion through reduction gearing, an overload prevention apparatus comprising a torque meter and a tachometer associated with each of said pinions or its said motor;

a computer for receiving input information sensed by each said torque meter and each said tachometer;

a torque adjust unit having an inverter for supplying an output to each said motor to adjust the motor according to said input information and according to stored information in said computer; and a pair of magnetic contactors and changeover switches for each of said motors with a brake, said magnetic contactors and changeover switches controlled by said computer being included in said electric circuit means.

* * * * *